US008215003B2

(12) United States Patent
Saka et al.

(10) Patent No.: US 8,215,003 B2
(45) Date of Patent: Jul. 10, 2012

(54) METHOD OF FABRICATING REACTOR

(75) Inventors: Kenji Saka, Oobu (JP); Yousuke Setaka, Anjo (JP); Hiroyuki Katsuta, Chiryu (JP); Takashi Yanbe, Sendai (JP)

(73) Assignees: Denso Corporation, Kariya (JP); NEC Tokin Corporation, Miyagi-ken (JP)

( * ) Notice: Subject to any disclaimer, the term of this patent is extended or adjusted under 35 U.S.C. 154(b) by 293 days.

(21) Appl. No.: 12/535,303

(22) Filed: Aug. 4, 2009

(65) Prior Publication Data

US 2010/0031497 A1 Feb. 11, 2010

(30) Foreign Application Priority Data

Aug. 7, 2008 (JP) ..... 2008-203875

(51) Int. Cl.
*H01F 7/06* (2006.01)

(52) U.S. Cl. ..... 29/605; 29/602.1; 29/604; 336/83; 336/110; 336/175; 336/178; 336/184; 363/17; 363/48; 363/58

(58) Field of Classification Search ..... 29/602.1, 29/604–607; 336/83, 110, 175, 178, 184, 336/214, 215, 234; 363/17, 48, 58
See application file for complete search history.

(56) References Cited

U.S. PATENT DOCUMENTS 4,372,351 A * 2/1983 Myers ..... 140/112
4,795,884 A * 1/1989 Carroll ..... 219/497
2005/0007232 A1 1/2005 Ono et al.
2005/0012581 A1 1/2005 Ono et al.

FOREIGN PATENT DOCUMENTS

| | | |
|---|---|---|
| JP | S56-157007 | 12/1981 |
| JP | S62-126615 | 6/1987 |
| JP | H01-283913 | 11/1989 |
| JP | H10-308315 | 11/1998 |
| JP | P2002-343626 A | 11/2002 |
| JP | 2006-004957 | 1/2006 |
| JP | P2008-147405 A | 6/2008 |

OTHER PUBLICATIONS

Japanese Office Action dated Feb. 28, 2012, issued in corresponding Japanese Application No. 2008-203875, with English translation.

* cited by examiner

*Primary Examiner* — Paul D Kim
(74) *Attorney, Agent, or Firm* — Nixon & Vanderhye PC

(57) ABSTRACT

A method of fabricating a reactor composed of a coil, a core, and a container, capable of suppressing the core to break when a current flows in the coil to generate magnetic flux. In the method, the coil is formed by spirally winding a conductive wire. The coil is immersed in an insulating film in liquid with electrical insulation. The coil is placed in a furnace. Annealing for the coil and thermosetting for the insulating film are performed at a temperature within 250 to 320° C. for a period of time within 30 minutes to one hour before forming the core in the container. The coil is then disposed in the container. Inside and outside areas of the coil in the container is filled with a resin mixture composed of magnetic powder and resin. The resin mixture in the container is hardened to form the core.

6 Claims, 4 Drawing Sheets

METHOD OF FABRICATING REACTOR

CROSS-REFERENCE TO RELATED APPLICATION

This application is related to and claims priority from Japanese Patent Application No. 2008-203875 filed on Aug. 7, 2008, the contents of which are hereby incorporated by reference.

BACKGROUND OF THE INVENTION

1. Field of the Invention

The present invention relates to a method of fabricating a reactor composed of a coil and a core to be applied to various types of electric conversion devices.

2. Description of the Related Art

There are many related-art documents for reactors. For example, Japanese patent laid open publication No. JP 2006-4957 has disclosed a reactor that is composed of a coil and a core. The coil is made of spirally-wound conductive wire to generate magnetic flux. The coil and the core are disposed in a container. The core is disposed at both the inside area and the outside area of the coil in the container. The core is made of a resin mixture of resin and magnetic powder.

In the conventional method of fabricating such a reactor, the coil is firstly made by spirally winding a conductive wire in a concentric configuration. The coil is then disposed in the inside area of the container, The coil in the container is then filled with a resin mixture composed of resin and magnetic power. Next, the resin mixture placed in the container is solidified to produce the core in which the coil is embedded.

However, such a conventional reactor fabricated by the conventional method has the following drawback. For example, because the conductive wire is made of copper, the coil is thermally expanded by Joule heat when a current flows in the coil. The thermal expansion presses the core surrounding the coil. In the reactor fabricated by the conventional method, there is a risk of applying excess thermal stress to the core, and thereby breaking the core. Breaking of the core divides the magnetic flux generated in the coil. This makes it impossible to obtain a desired amount of inductance in the reactor because of generating an insufficient amount of magnetic flux in the reactor.

SUMMARY OF THE INVENTION

It is an object of the present invention to provide a method of fabricating a reactor composed of a coil and core in a container capable of suppressing the core from breaking even if stress is generated, and applied to the core.

To achieve the above purposes, the present invention provides a method of fabricating a reactor capable of suppressing a core from breaking under generating stress, for example, when a current flows in a coil, and the generated stress is applied to the core. The reactor is comprised of a coil, a core, and a container. The core is made of a resin mixture composed of magnetic powder and resin. An inside area and an outside area of the coil in the container is filled with the resin mixture. In particular, the method according to the present invention has a step of annealing the coil before forming the core in the inside area and the outside area of the coil in the container. In the method according to the present invention, annealing of the coil is performed before forming the core. This can decrease stress generated in and applied to the inside of the core.

On the other hand, various conventional reactor-fabricating methods form a coil by spirally winding a conductive wire, and then embed the coil directly into a resin mixture composed of magnetic powder and resin without annealing the coil. There are no drawbacks caused from a combination of the coil and the resin mixture. Skilled persons in this art commonly think that using a hardened coil is better for a reactor because of increasing the strength of the coil in the reactor. However, the temperature of the coil is increased by Joule heat generated when a current flows in the coil. The coil is thermally expanded. The expanded coil forcedly presses the core which is formed around the coil. This often causes the core to break. The reactor fabricated by the above conventional method has such a drawback.

In the method of fabricating the reactor according to the present invention, annealing is performed on the coil before the core is formed in the inside area and the outside area of the coil in the container. To perform annealing on the coil can decrease the elastic modulus of the conductive wire which forms the coil, which has been increased in the coil formation process. In addition, performing such an annealing can decrease yield strength of the conductive wire. This can decrease the magnitude of the stress generated when a current flows in the coil and the coil is thermally expanded. As a result, it is possible to suppress the core in the reactor from breaking. That is, the present invention provides a method of fabricating reactors capable of suppressing breakage of the core surrounding the coil in the container.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
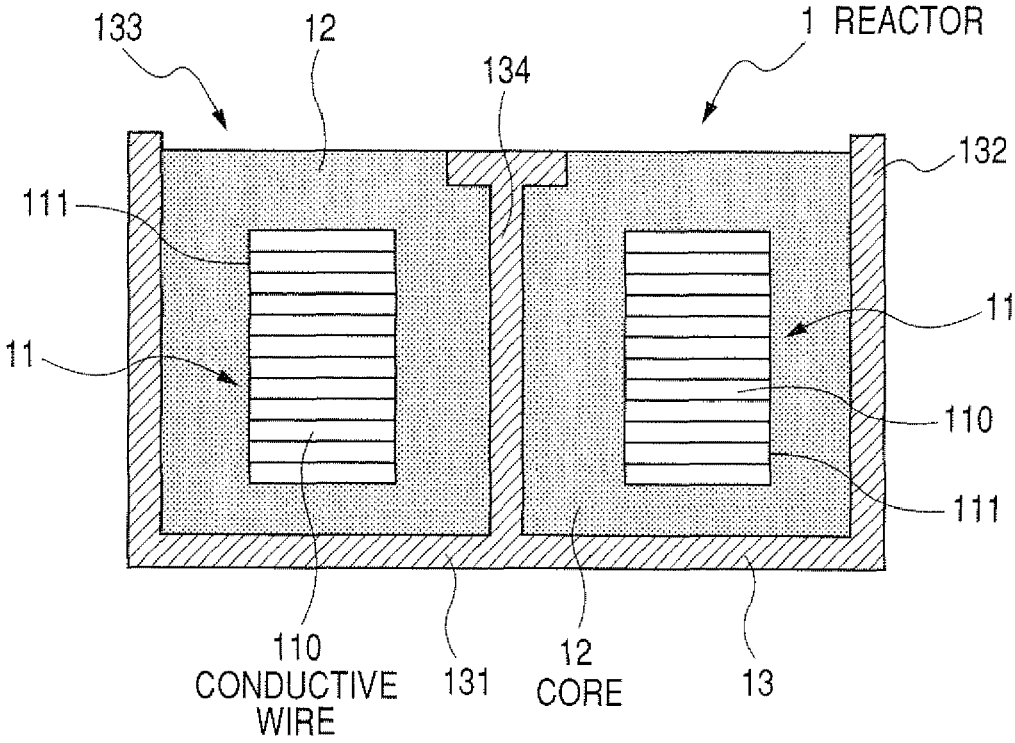
FIG. 1 is a vertical cross-sectional view showing a reactor fabricated by the method according to a first embodiment of the present invention.

Hereinafter, various embodiments of the present invention will be described with reference to the accompanying drawings. In the following description of the various embodiments, like reference characters or numerals designate like or equivalent component parts throughout the several diagrams.

First Embodiment

A description will be given of a reactor and a method of fabricating the reactor according to the first embodiment of the present invention with reference to FIG. 1, FIG. 2, FIG. 3A to FIG. 3C, and FIG. 6.

Figure 2:
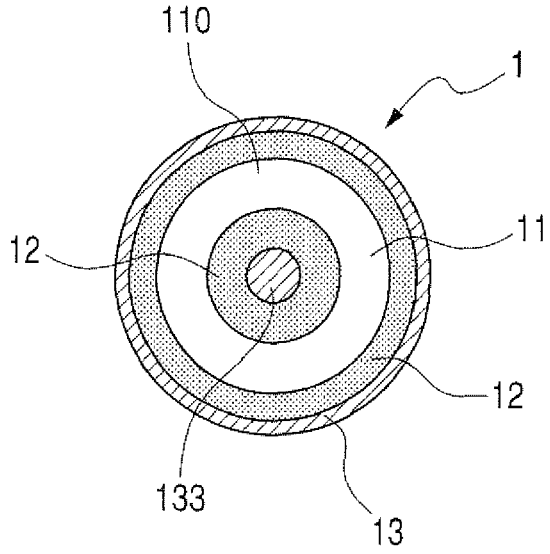
FIG. 2 is a horizontal cross-sectional view showing the reactor shown in FIG. 1.

FIG. 1 is a vertical cross-sectional view showing the reactor 1 fabricated by the method according to the first embodiment of the present invention. FIG. 2 is a horizontal cross-sectional view showing the reactor 1 shown in FIG. 1.

As shown in FIG. 1 and FIG. 2, the reactor 1 is made of a coil 11, a core 12, and a container 13. The coil 11 is formed by spirally winding a flat type conductive wire 110, for example, one hundred times. The coil 11 generates magnetic flux when a current flows therein. The core 12 is made of a resin mixture (or a mixed resin) composed of magnetic powder and resin. The inside area and the outside area of the coil 11 in the container 13 is filled with the resin mixture to form the core 12. The first embodiment will show a method of producing the above reactor 1.

In the method of fabricating the reactor 1 according to the first embodiment of the present invention, the coil 11 is annealed before forming the core 12 in the inside and outside of the coil 11 in the container 13.

A description will now be given of the reactor 11 fabricated by the method according to the first embodiment of the present invention. The method of fabricating the reactor 1 will be described later in detail.

For example, the reactor 1 is applied to electric power conversion devices such as a DC-DC converter and an inverter to boost an input voltage.

The reactor 1 is composed of the coil 11, the core 12, and the container 13. The container 13 accommodates the coil 11 and the core 12. The container 13 is made of aluminum having superior heat radiation properties, for example.

The container 13 is composed of a bottom surface 131 of a circle plate and a cylindrical side surface 132.

The container 13 has a radiating pole part 134. The radiating pole part 134 is formed on the central part of the bottom surface 131 toward the opening part 133 of the container 13. That is, the radiating pole part 134 projects from the bottom surface 131 to the opening part 133 of the container 13. It is possible to radiate heat energy generated in the coil 11 through the radiating pole part 134 to the outside of the reactor 1. The flat type conductive wire 110 forming the coil 11 is made of copper or aluminum.

The coil 11 is made of the flat type conductive wire 110 shown in FIG. 1 and FIG. 2. The coil 11 is placed in the container 13 so that the radiating pole part 134 is surrounded by the coil 11.

For example, the resin mixture forming the core 12 is composed of resin such as epoxy resin or thermoplastic resin and magnetic powder such as ferrite powder or iron silicon alloy powder. It is possible for the core 12 to have an elastic modulus of 1 to 35 GPa.

A description will now be given of the method of fabricating the reactor 1 according to the first embodiment with reference to FIG. 2, FIG. 3A to FIG. 3C, and FIG. 6.

Figure 3A:
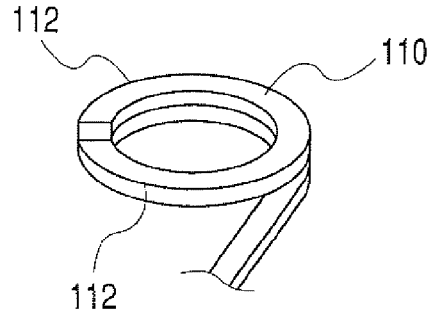
FIG. 3A is a perspective view showing a flat type conductive wire to be used in the method according to the present invention.
Figure 3B:
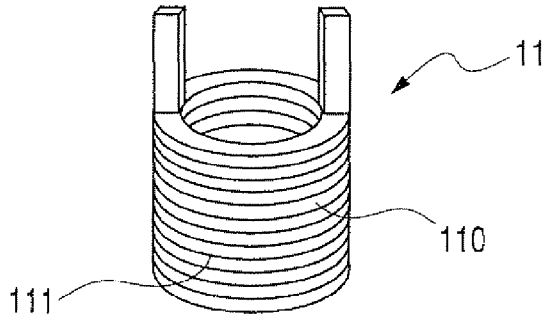
FIG. 3B is a perspective view showing a coil composed of the flat type conductive wire shown in FIG. 3A which is spirally wound.
Figure 3C:
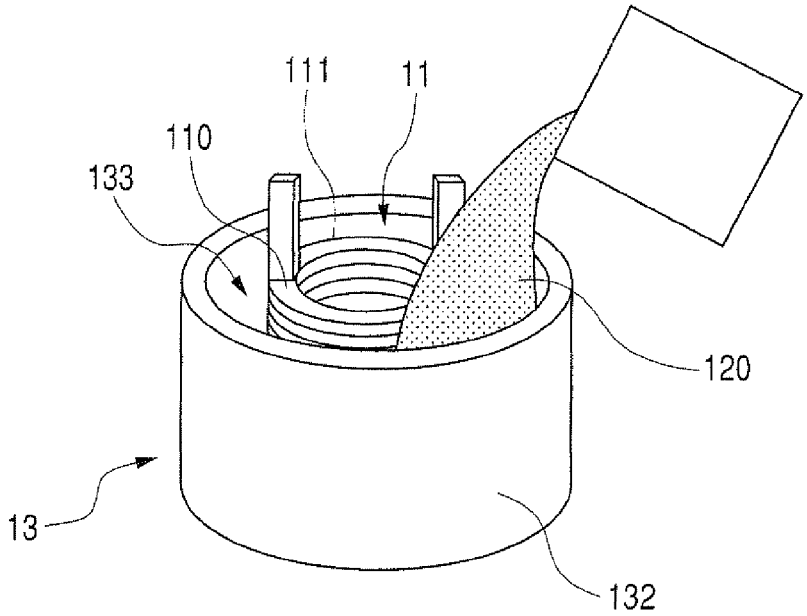
FIG. 3C is a perspective view showing a state of filling a resin mixture composed of magnetic power and resin into a container in which the coil and the core re disposed.
Figure 6:
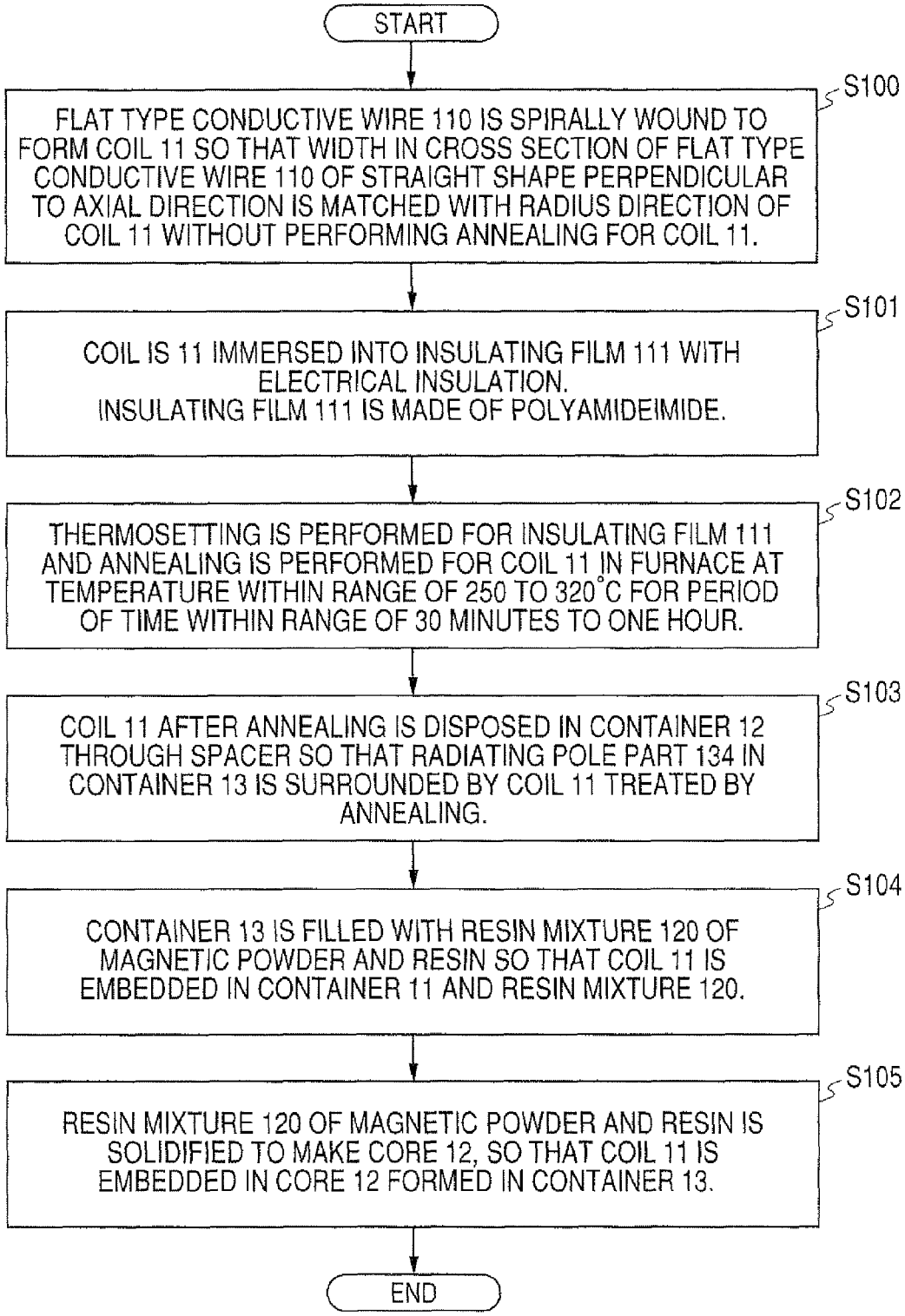
FIG. 6 is a flow chart showing the method of fabricating the reactor according to the first embodiment of the present invention.

FIG. 3A is a perspective view showing the flat type conductive wire 110 to be used in the method of the first embodiment. FIG. 3B is a perspective view showing the coil 11 made of the flat type conductive wire 110 shown in FIG. 3A. FIG. 3C is a perspective view showing a state when the container 13 in which the coil 11 is disposed is filled with the resin mixture composed of magnetic power and resin. FIG. 6 is a flow chart showing a method of fabricating the reactor 1 according to the first embodiment.

First, the single flat type conductive wire 110 shown in FIG. 3A is spirally wound edgewise in a concentric configuration in order to form the coil 11 shown in FIG. 3B (step S100). Specifically, the flat type conductive wire 110 is wound to form the coil 11 so that the width of the cross section of the flat type conductive wire 110 of a straight shape perpendicular to the axial direction is matched with the radial direction of the coil 11. At this time, no annealing for the coil 11 is performed.

The coil 11 before annealing has an elastic modulus within a range of 100 to 130 GPa, and yield strength within a range of 250 to 500 MPa, for example.

Next, the coil 11 is immersed into an insulating film in liquid with electrical insulation (step S101). For example, the insulating film 11 is made of polyamideimide. As shown in FIG. 3B, it is possible to adequately and completely apply the insulating film 111 to the coil 11 when the insulating film 111 has viscosity of not more than 20 Pa·s.

Next, the thermosetting is performed for the insulating film 111. At the same time, the coil 11 is also annealed. For example, the thermosetting of the insulating film 111 and the annealing of the coil 11 are performed in a furnace at a temperature within a range of 250 to 320° C. for a period of time within a range of 30 minutes to one hour (step S102). It is thereby possible for the conductive wire 110 to have elastic modulus within a range of 80 to 100 GPa, and the yield strength within a range of 50 to 100 MPa.

Next, as shown in FIG. 1 and FIG. 2, the coil 11 treated by annealing is disposed in the container 12 through the inside of a spacer (omitted from drawings) so that the radiating pole part 134 in the container 13 is surrounded by the coil 11 treated by annealing (step S103).

Next, as shown in FIG. 3C, the container 13 is filled with the resin mixture 120 of magnetic powder and resin so that the coil 11 is embedded in the container 11 and the resin mixture 120 (step S104).

Next, the resin mixture 120 of magnetic powder and resin is solidified to produce the core 12 (step S105). This makes the reactor 1 in which the coil 11 is embedded in the core 11 in the container 13.

The present invention is not limited by the above-described method of fabricating the reactor 1. It is possible to perform variable modifications of the method in order to fabricate the reactor 1 according to the present invention.

Next, a description will be given of effects and actions according to the present invention.

In the method of the first embodiment according to the present invention, the coil 11 is annealed before forming the core 12 in the inside area and the outside area of the coil 11 in the container 13. This allows the stress applied to the inside of the core 12 in the reactor 1 to be decreased. That is, in the method of the first embodiment, annealing is performed to the coil 11 before forming the core 12 in the inside area and the outside area of the coil 11 in the container 13. This can suppress the core 12 from breaking without drastically changing its mechanical property and physical property. As a result, it is possible to suppress the core 12 in the reactor 1 from breaking.

In the method according to the first embodiment of the present invention, because the annealing for the coil 11 and the thermosetting for the insulating film 111 are simultaneously performed after applying the insulating film with electric insulation property in liquid onto the coil 11, it is possible to decrease the magnitude of stress applied to the inside of the core 12. This can also decrease the total number of steps of fabricating the reactor 1. That is, according to the present invention, the annealing for the coil 11 and the thermosetting for the insulating film 111 are simultaneously performed after immersing the coil 11 into the insulating film in liquid. This can avoid the annealing for the coil 11 and the thermosetting for the insulating film 111 to be independently performed. This can decrease the total number of fabrication steps for the reactor 1.

Still further, because the conductive wire 110 is made of copper or aluminum, it is possible to suppress breakage of the core 12. That is, because the conductive wire 110 is made of copper or aluminum, the thermal expansion of copper is very high. Applying the method according to the present invention to the reactor 1 in which the coil 11 is formed with the conductive wire 110 made of copper or aluminum can adequately decrease the magnitude of stress to be applied to the inside area of the core 12.

Still further, the coil 11 is formed using the flat type conductive wire 110 by an edgewise process. That is, when the coil 11 is formed by edgewise process, as shown in FIG. 3A, the outer peripheral part 112 of the flat type conductive wire 110 in the radial direction of the coil 11 is partially hardened. Performing annealing on the coil 11 obtained from the flat type conductive wire 110 by edgewise process can decrease the elastic modulus and the mechanical strength at the part 112 (see FIG. 3A) of the coil 11, where the part 112 can easily be hardened. Thus, the features of the present invention can be applied to the reactor 1 having the above structure.

As describe above in detail, the present invention provides the reactor 1 capable of suppressing the core from breaking, and the method of fabricating the reactor 1.

Second Embodiment

A description will be given of the feature of the reactor 1 fabricated by the method according to the first embodiment of the present invention with reference to FIG. 4 and FIG. 5.

In the second embodiment, the stress applied to both products was detected, in both the reactor 1 fabricated by the method according to the first embodiment and a conventional reactor when the stress causes strain in the conductive wire forming the coil.

In particular, the coil 1 in the reactor 1 according to the present invention was annealed after the conductive wire 110 was wound to form the coil 11. Specifically, the coil 11 was annealed in a furnace at 300° C. for one hour after the coil 11 was formed before forming the core 12 in the container 13.

On the other hand, the conventional reactor made by the conventional method was not treated by any annealing.

In the comparison process, current was applied to the products, namely, the reactor 1 according to the present invention and the conventional reactor in order to thermally expand them. The stress applied to the core 12 in the reactor 1 and the core in the conventional reactor was then detected. The mechanical property of each of the reactor 1 and the conventional reactor was also detected.

Figure 4:
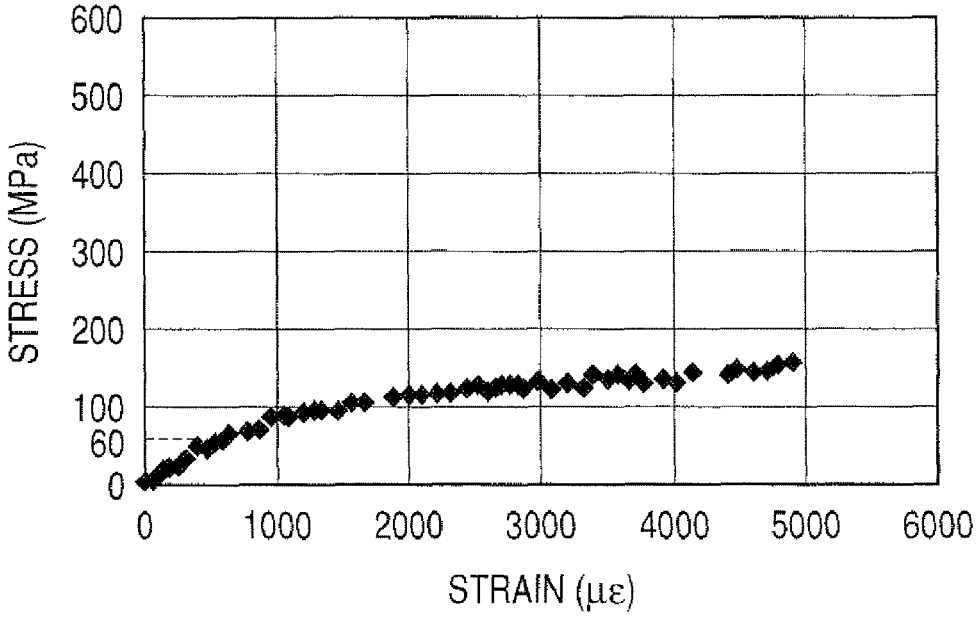
FIG. 4 is a graph showing a relationship between stress applied to the core and strain of the conductive wire which forms the coil in the reactor fabricated by the method according to the present invention.
Figure 5:
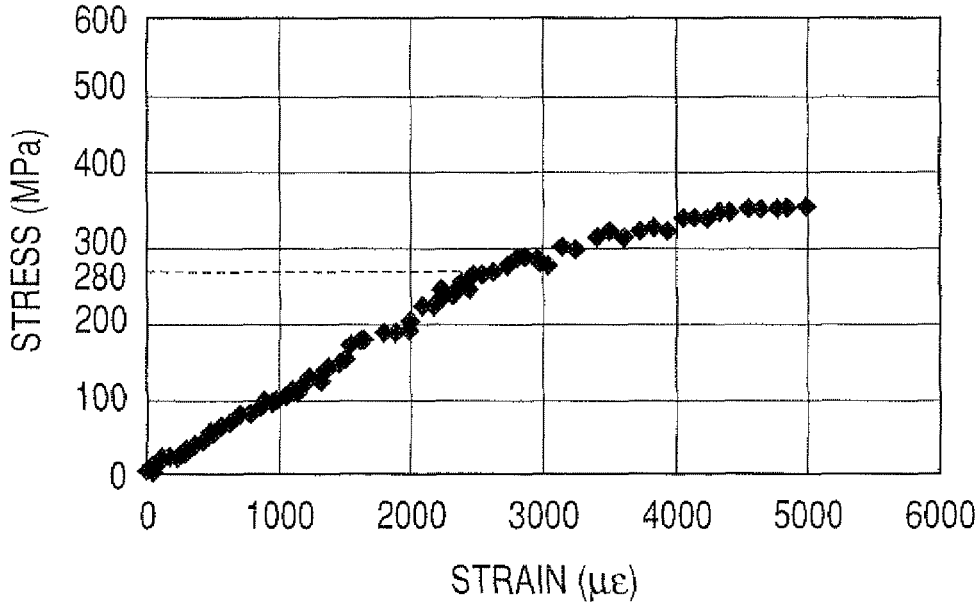
FIG. 5 is a graph showing a relationship between stress applied to a core and strain of a conductive wire which forms a coil in a reactor fabricated by a conventional method.

As shown in the comparison results shown in FIG. 4 (relating to the present invention) and FIG. 5 (relating to the conventional reactor), the reactor 1 according to the present invention has a small stress of 160 MPa when the strain of the conductive wire 110 generated in the inside of the coil 11 is 5000με. In addition, the yield strength of the conductive wire 110 forming the coil 11 in the reactor 1 according to the present invention is 60 Mpa which is adequately small when compared with that in the conventional reactor (will be described later). The elastic modulus of the conductive wire 110 forming the coil 11 in the reactor 1 according to the present invention is 90 GPa.

On the other hand, as clearly shown in FIG. 5, the conventional reactor (which was not performed by annealing for the coil) has a large stress of 360 MPa when the strain of the conductive wire generated in the inside of the coil is 5000με. In addition, the yield strength of the conductive wire forming the coil in the conventional reactor is 280 Mpa which is large when compared with that in the reactor 1 according to the present invention. The elastic modulus of the conductive wire forming the coil in the conventional reactor is 120 GPa.

As described above in detail, it is possible for the method of the present invention to fabricate the reactor 1 having adequately small stress applied to the core 12, and adequately small yield strength of the conductive wire 110.

(Other Features and Effects of the Present Invention)

It is possible to apply the reactor to electric power conversion devices such as a DC-DC converter and an inverter.

For example, it is possible to use a resin mixture composed of magnetic powder and thermosetting resin such as epoxy resin or thermoplastic resin. It is also possible to use ferrite powder, iron silicon alloy powder as the magnetic powder. The coil is composed of the conductive wire spirally wound in concentric shape. The coil generates magnetic flux when a current flows therein.

In the method as another aspect of the present invention, it is preferable that the annealing of the coil and thermosetting of the insulating film are simultaneously performed after the insulating film solution with electric insulation property is applied on the coil.

This can fabricate the reactor capable of decreasing the stress to the core when a current flows in the coil. The method also decreases the total steps of fabricating the reactor. That is, the method of the present invention simultaneously performs annealing of the coil and thermosetting of the insulating film after the coil is immersed into the insulating film in liquid with electric insulation property. This can decrease the total number of steps of fabricating the reactor when compared to a conventional method which separately and independently performs the annealing of the coil and the thermosetting for the insulating film.

In the method as another aspect of the present invention, it is preferable that a wire made of one of copper and aluminum is used as the conductive wire. This can effectively suppress the core from breaking when a current flows in the coil. That is, when the conductive wire forming the coil is made of copper or aluminum, it often occurs that the coil is thermally expanded by Joule heat when a current flows in the coil. Applying the method of the present invention to the process of fabricating the reactor with a coil composed of a conductive wire made of copper or aluminum can adequately decrease the stress from the coil to the core when a current flows in the coil of the reactor.

In the method as another aspect of the present invention, it is preferable that the coil is formed using a flat type conductive wire by an edgewise process.

This can effectively obtain the effect and action of the method according to the present invention. That is, when the coil is formed by an edgewise process which is a well known process, the outside part in the radial direction of the coil composed of the conductive wire is partially hardened by this edgewise process. Performing the annealing of the coil can decrease elastic modulus and yield strength of the hardened outside part of the coil. This structure of the reactor can suppress the core from breaking when a current flows in the coil.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A method of fabricating a reactor comprised of a coil, a core, and a container, where the coil is composed of a wound conductive wire, the coil generates magnetic flux when a current flows in the coil, and the core is made of a resin mixture of magnetic powder and resin, and placed in an inside area and an outside area of the coil in the container, the method comprising steps of:

annealing the coil before forming the core in the inside area and the outside area of the coil in the container, wherein annealing of the coil and thermosetting of an insulating film are simultaneously performed after an insulating film solution with electric insulation property is applied on the coil.

2. The method of fabricating a reactor according to claim 1, wherein a wire made of one of copper and aluminum is used as the conductive wire.

3. The method of fabricating a reactor according to claim 1, wherein the coil is formed using a flat type conductive wire by an edgewise process.

4. A method of fabricating a reactor comprised of a coil and a core, comprising steps of:

spirally winding a flat type conductive wire to form the coil;

immersing the coil into an insulating film in liquid with electrical insulation;

disposing the coil in a furnace;

simultaneously performing annealing for the coil and thermosetting for the insulating film coated on the coil at a temperature within a range of 250 to 320° C. for a period of time within a range of 30 minutes to one hour;

placing the coil in a container;

filling an inside area and an outside area of the coil in the container with a resin mixture composed of magnetic powder and resin; and hardening the resin mixture in the container to form the core in the inside area and the outside area of the coil in the container.

5. The method of fabricating a reactor according to claim 4, wherein the container with a radiating pole part is used, where the radiating pole part is formed on a central part of a bottom surface of the container toward an opening part of the container.

6. The method of fabricating a reactor according to claim 4, wherein annealing is performed to make the conductive wire which forms the coil have an elastic modulus within a range of 80 to 100 GPa, and yield strength within a range of 50 to 100 MPa.

* * * * *